US008714971B2

(12) United States Patent
Møller et al.

(10) Patent No.: US 8,714,971 B2
(45) Date of Patent: May 6, 2014

(54) PORTABLE CATALYTIC HEATING SYSTEM FOR OFF GRID APPLICATION

(75) Inventors: Frederik Gundelach Møller, Charlottenlund (DK); Hans Jessen Møller, Harlev J (DK)

(73) Assignee: Heatgear Professional ApS, Viby J (DK)

( * ) Notice: Subject to any disclaimer, the term of this patent is extended or adjusted under 35 U.S.C. 154(b) by 932 days.

(21) Appl. No.: 12/223,149

(22) PCT Filed: Aug. 23, 2006

(86) PCT No.: PCT/DK2006/000457

§ 371 (c)(1), (2), (4) Date: Jul. 23, 2008

(87) PCT Pub. No.: WO2007/085251

PCT Pub. Date: Aug. 2, 2007

(65) Prior Publication Data

US 2010/0285416 A1 Nov. 11, 2010

(30) Foreign Application Priority Data

Jan. 26, 2006 (DK) ..... 2006 00113

(51) Int. Cl.
*F24H 1/20* (2006.01)

(52) U.S. Cl.
USPC ..... 432/175; 431/328; 431/344; 126/360.1

(58) Field of Classification Search
USPC ..... 432/72, 175; 126/263.01, 406, 408, 126/409, 348, 360.1, 360.2, 368.1, 126/373.1–390.1; 431/5, 7, 115, 116, 255, 431/328, 344
See application file for complete search history.

(56) References Cited

U.S. PATENT DOCUMENTS

| | | | | |
|---|---|---|---|---|
| 3,223,081 | A * | 12/1965 | Hunt | 126/360.1 |
| 3,251,355 | A | 5/1966 | Keating | |
| 4,416,298 | A | 11/1983 | Berghammer | |
| 4,420,462 | A | 12/1983 | Clyde | |
| 4,519,770 | A * | 5/1985 | Kesselring et al. | 431/7 |
| 4,552,124 | A * | 11/1985 | Nakajima | 126/413 |
| 4,641,632 | A * | 2/1987 | Nakajima | 126/413 |
| 4,690,127 | A * | 9/1987 | Sank | 126/391.1 |
| 5,195,502 | A | 3/1993 | Hanning | |
| 5,215,076 | A | 6/1993 | Oglesby | |
| 5,304,354 | A * | 4/1994 | Finley et al. | 422/612 |
| 5,485,829 | A | 1/1996 | Santhouse et al. | |
| 5,586,877 | A * | 12/1996 | Charmes | 431/115 |
| 5,771,881 | A | 6/1998 | Oglesby et al. | |
| 5,921,231 | A | 7/1999 | Butler | |
| 5,944,508 | A | 8/1999 | Bonnema | |
| 6,575,154 | B1 | 6/2003 | Freeman, Jr. et al. | |
| 6,644,301 | B2 * | 11/2003 | Farone | 126/271.1 |
| 6,874,498 | B2 * | 4/2005 | Oglesby et al. | 126/414 |
| 2010/0139599 | A1 * | 6/2010 | Vestin | 123/143 B |

* cited by examiner

*Primary Examiner* — Gregory A Wilson
(74) *Attorney, Agent, or Firm* — James Creighton Wray

(57) ABSTRACT

A portable catalytic heating system for off grid application, in which the heating system comprises a heating unit with a handle (4) and an, in extension hereof arranged, heating pipe (5) containing a catalytic burner (20) for catalytic combustion of gases for providing infra-red radiation, where the heating pipe (5) is produced in a material that is transparent for infra-red radiation and fluid-proof for immersion in liquids.

14 Claims, 7 Drawing Sheets

PORTABLE CATALYTIC HEATING SYSTEM FOR OFF GRID APPLICATION

This application claims the benefit of Danish Application No. PA 2006 00113 filed Jan. 26, 2006 and PCT/DK2006/000457 filed Aug. 23, 2006, which are hereby incorporated by reference in their entirety.

The present invention relates to a portable catalytic heating system for off grid application.

DESCRIPTION OF THE PRIOR ART

Infra-red radiation is the part of the electromagnetic spectrum that comprises wave-lengths between 0.76 and 100 μm of which only radiation up to 10 μm is being applied industrially. The spectrum can be divided into three "bands":

short-wave IR radiation: 0.76-2 μm medium-wave IR radiation: 2-4 μm, and long-wave IR radiation: 4-10 μm Outside the infra-red area, to one side of the radiation spectrum we have the visible light (shorter wavelengths); to the other side (longer wavelengths) we are approaching the radio wave area.

The wavelengths of the IR radiation correspond to the weak photons (<4.10-19 J), which is not suspected to weaken materials by modification of the molecular structure, in contrast to radiation with higher energy levels: UV, X and gamma. Accordingly, the infra-red radiation has a pure thermic effect.

A catalytic heater produces heat without generation of a flame. Catalytic infra-red radiation is produced in a process that is called an oxidation-reduction-reaction. When hydrocarbon is combined with oxygen in the presence of a heated catalyst, the exothermic reaction releases infra-red energy and produces CO2 and water vapour.

Catalytic heaters are described in the American U.S. Pat. No. 4,420,462 by Clyde for heating of liquid, which flows through pipes near the heater, and in the American U.S. Pat. No. 5,215,076 by Oglesby et al. primary for soldering.

Catalysis occurs in the temperature range 370-425° C. These temperatures correspond to IR wavelengths about 3-7 μm, which basically coinciding with the maximal absorption spectrum of water, which is in the range of 3-7 μm. Consequently, IR heating is well suited for heating of water in sundry materials. Thus, it is known that catalytic heaters can be used in hair curlers, by way of example as described in the American U.S. Pat. No. 4,416,298 by Berghammer.

The function of a catalytic heater can be described in the following way. In a gas-fired catalytic infra-red heating panel gas is feed through the catalytic medium. The IR element primary consists of a catalytic material with an evenly distributed mesh or a fibre structure, which offers a maximal surface area and allows the catalyst to react with optimum efficiency.

In catalytic infra-read heating is applied a catalytic reaction between fuel, oxygen and heat for generation of infra-red radiation. The catalytic reaction is generated by application of a substance (catalyst), which creates a thermodynamical reaction between the substance and the heat. Or stated more simply: Changes and acceleration in the chemical reaction that is triggered by the substance (the catalyst), which in itself remains unchanged.

The burning process normally (i.e. without a catalyst) starts at about 500° C. When the catalyst is added the process occurs faster and at a lower temperature. At 250° C. the oxidization can occur, provided that the other conditions are met, however, it concerns oxidization without fire (ignition) and flame.

When the catalyst, by preheating, has reached a temperature at 150° C., as an example, the gas passes by the heated catalytic material. The gas gets into contact with the warm catalyst and reacts with the oxygen of the air, by which the temperature of the catalyst is raised to between 175 and 440° C., at the same time as it emits infra-red energy. Efficiency tests have shown that up to 72% of the energy in the gas is converted to infra-red heat energy. Since the reaction temperature is much lower than the ignition temperature for gas (above 700° C.) the reaction is flameless. The catalytic reaction can be established few seconds after the gas has reached the panel.

OBJECT OF THE INVENTION

It is the object of the invention to provide a catalytic heater for heating of water and watery liquids and watery masses, in which the heat is easy to transport and meet the needs required by individuals that stay in the nature/outdoors and that need a dependable and efficient off grid heating system for their food and beverages. The target group is i.a. military units, special units, hikers, trekkers and families with children.

This object is achieved by a portable catalytic heating system for off grid application, in which the heating system comprises a heating unit with a handle and an, in extension hereof arranged, heating pipe containing a catalytic burner for catalytic combustion of gases for providing infra-red radiation, where the heating pipe is produced in a material that is transparent for infra-red radiation and fluid-proof for immersion in liquids. It is constructed in such a manner that it can be applied in all positions. It means that the handle may be placed both below and above the medium that has to be heated.

Catalytic heating systems are in general known as being dependable, robust and to have a high degree of efficiency. Accordingly, a relatively small and light apparatus may be produced, which makes it suitable to carry it at a trek or at a military operation. Hence, it is also beneficial to apply it in third-world countries due to the robust form of construction and because of low manufacturing costs. It may for instance be used for sterilization of water.

This invention makes it possible to avoid the use of cooking vessels and pots in the process of off grid heating of canned goods, ready-prepared drinks, watery liquids or freeze-dried food. This opportunity means that one obtain a much better hygiene and state of health, because there will not occur a contamination of the cooking vessel or the pot and the need for washing-up is largely reduced compared with the heating systems available today, since the heating unit is self-disinfectant. The system layout permits furthermore that the heating system can be applied as heater and hot-water bottle.

The heating element comprises a catalytic IR-burner, which gives off its heat, to the medium that is to be heated, via a combination of infra-red radiation and thermal convection.

In practice a catalytic IR-burner will give off up to about 70% of its energy in the form of radiant heat, while the remaining about 30% will be given off partly to the off-gas as convection heat (20%) and partly as visible and UV-light etc. (ca. 10%), why the invention has large energy efficiency and very low damaging emission values.

The catalytic heating system applies combustion of gas (natural gas—propane, butane gas or mixtures hereof) in a catalytic element, which may comprise a cylindrical or flat catalytic element of a ceramic, metal or filtering material.

In comparison with conventional heating systems for field rations etc. applied in the nature, the primarily difference in the operational principle and the efficiency, that the conventional heating is provided from the outside and into the material and there is a rather low efficiency, typically about 18-20% due to the huge emission of heat to the surroundings.

By a catalytic infra-red heating combined with convection heating the heating is provided both from the inside of and out of the material as well as from the outside and into the material. This involves a more regular heating of the medium to be heated. This effect is furthermore utilised by having the heating element immerged and placed centrally in the medium that is to be heated. The efficiency is typically over 70%.

Catalysis occurs in the temperature range 370-425° C. These temperatures corresponds to a IR wavelength of 3-7 μm, which means that this IR-radiation emission spectrum is substantially coinciding with the maximal absorption spectrum of water, which is in the range 3-7 μm. Accordingly, Catalytic IR heating is well suited for heating of materials with a relatively high water content, which is characteristic for food products and beverages.

Since this heating system is intended to be immerged directly into the medium to be heated, there has to be provided a water-proof separation between the medium to be heated and the catalytic heating element. In order to enhance the efficiency of the transmission of the IR radiation there has to be provided a partition wall made in a material that can be optimised with regard to both transmission of IR radiation and transfer of convection heat. The partition wall may comprise either aluminium, copper or quartz glass or a combination of these.

Catalytic infra-red heating is approved by Factory Mutual for Class 1, Division 2, Group D, and Canadian Standards Association for Class 1, Division 1, Group D hazardous locations.

A flameless catalytic heating element is suitable for being operated in dangerous areas such as chemical or petrochemical storing sites and places, with inflammable or explosive gases or steams. A flameless catalytic heating element can also be safely operated in areas with highly flammable dust or metal dust and in building areas, where gas-powered vehicles are being maintained, stored or parked.

In a concrete embodiment there is provided a venturi system for mix of fuel gas and air in between the gas tank and the catalytic burner. A venturi system is robust and dependable and may be manufactured in a great number for low costs, which for a system according to the invention is a huge advantage because is considered to be distributed among many users.

In another embodiment a counter-flow heat exchanger is provided between a pipeline for air supply and a pipeline for vent gases for heat exchange between vent gas and supplied air.

For use in the military the heating system according to the invention has the advantage that it is more difficult to trace in use than conventional heating methods. The heating system according to the invention entail that there is not occurring any form of visible flame in use. The system layout secures that the heating unit that comprises the IR burner is surrounded by the medium, which has to be heated, coincident with that the exhaust gas is cooled to the maximum via a cross-flow heat exchanger, which secures that the heat from the exhaust gas partly is transferred to the gas tank, which uses heat as the gas is converted from being a liquid to being gaseous for combustion and partly to the intake air to the catalytic burning.

Accordingly, there is only a weak thermal profile in use. The concept layout secures furthermore, that the sound level is very low and that no smoke is formed.

Moreover, between a gas tank in the heating system and a pipeline for vent gases there may by provided a heat exchanger, optionally identical to the previously mentioned heat exchanger. Thereby it is secured that the apparatus also can be applied at very cold conditions.

Due to the high efficiency, which is more than 3 times better than the off grid heating systems with cooking vessels and pots used today, this heating system is both energy-efficient and environmentally benign. The energy consumption is very low, namely only about 10-12 gram gas per liter water heated to 80 degrees Celsius. By way of example a propellant as natural gas, propane gas, butane gas, isobutene gas or a mixture hereof is being used. According to all prognoses it should be possible to supply butane gas for the next 100 years. Heating units may in practice also apply hydrogen as propellant without significant changes.

Therefore, the application of a heating system according to the invention is associated with a number of advantages. Firstly, catalytic combustion is based on technologies that are far less polluting than the present off grid heating methods. Furthermore, the heating system of the invention and its energy medium is lighter and takes up less space than the present off grid systems. Catalytic combustion has been known and used for more that hundred years in other applications why the technology is thoroughly tested and safe.

It is moreover possible to provide the heating system with an internal piezoelectric ignition system to start the catalytic combustion in all weather conditions also in the heavy snow storms and tropical storms and heavy rainfalls without preparation or requirements regarding temperature or the physical surrounding. The unit does not make demands on the base or any other kind of preparation, which is why it can be started and operated by one hand. The system layout permits that the heating unit can be carried by the user in use, which is why it is possible to start and heat during motion, march or military work.

That heating system, to witch the invention is related, can directly be incorporated in the delivery channels, supplier channels and distribution channels that is used today, because a standard propellant and available raw materials and semi-finished products is applied, which is why it will not be difficult to establish a full delivery system with delivery of a propellant in standard units and servicing of the equipment. Hence the heating system according to the invention may comprise an exchangeable gas tank, arranged in the handle if desired.

The invention relates to a robust, energy efficient and thoroughly tested principle, which takes up less space and is lighter than the existing systems, which are based on external heating of cooking vessels/pots by means of for instance spirit tablets, multi-fuel burners, spirit boilers or gas flames. Basically there is no wear on the system, why service and maintenance is reduced to an absolute minimum.

The typical user can by the invention achieve i.a. the following advantages: faster and much easier heating of i.a. field rations, emergency rations, water, milk and baby food. There will be no problems regarding washing-up in those cases where the packaging is used as cooking vessel. It will always be possible to have access to hot drinks and sterilization of water and there is no requirements to the surroundings at all, because the heating system function without problems in all the places, in which the user can cary out his service also regarding transport. The heating system can, furthermore, also be applied as a hot-water bottle and finger heater and generally as heater against frost-bites.

The concept, the system layout and the applied combustion technology in the heating system according to the invention secure all together the user a greater safety, comfort and user friendliness.

A portable catalytic heating system according to the invention, where the handle is provided with an adapter for fluid-proof attachment of the heating unit to a tank with a corresponding adapter.

A portable catalytic heating system according the invention, where gas supply to the catalytic burner in the heating pipe is provided between the catalytic burner and the inner wall of the heating pipe. By this way, the temperature of the supplied gas is reduced and secures a good catalytic combustion with high degree of efficiency.

BRIEF DESCRIPTION OF THE DRAWING

The invention is described further refereeing to the drawing, where.

DETAILED DESCRIPTION OF THE INVENTION

Figure 1A:
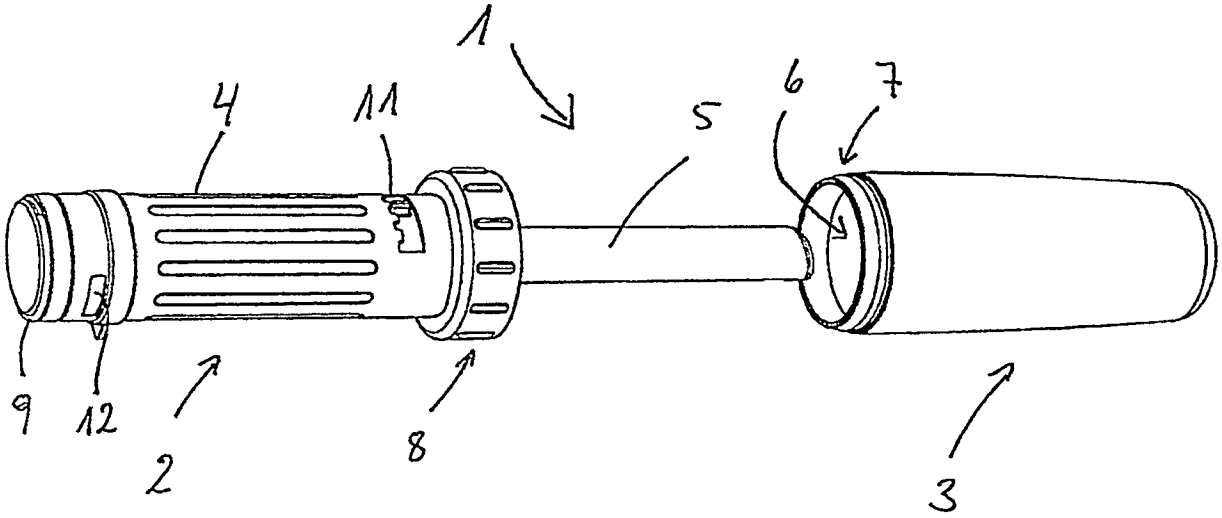
FIG. 1 shows a heating unit according to the invention together with a protective tank a) removed and b) mounted.

FIG. 1 shows a heating system 1 according to the invention. The heating system 1 comprises a heating unit 2 and a protective tank 3. The heating unit 2 has a handle 4 for attachment of the heating unit 2 and a heating pipe 5 that transmits heat radiation from the catalytic element contained in the heating pipe 5. The heating pipe 5 can be fitted into a protective tank 3, when the heating system is not in use. The tank 3 may also be used for storing of fluids or other materials such as powder, as an example in connection to heating with the heating pipe 5 or in order to constitute a storage of fluid or other materials in during transport. The tank 3 may by way of example comprise hot fluid and function as a thermos bottle or for heating of the hands. The tank 3 is isolated in order to reduce the output of energy to the surroundings.

Figure 1B:
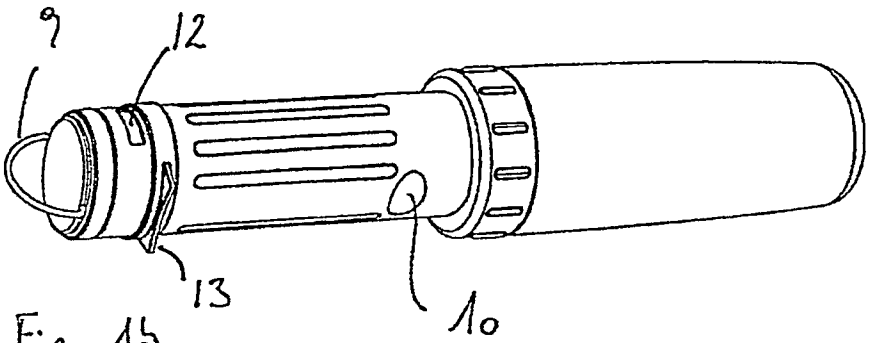

The tank 3 is open in its upper extremity 6 and by the edge provided with a thread 7 corresponding to an internal thread (not shown) in an adapter 8 in one extremity of the handle 4. FIG. 1*a* shows the heating unit 2 and the tank 3 separated from each other, while FIG. 1*b* shows the heating unit 2 and the tank 3 in a situation, in which they are screwed together.

It should be noted that the tank may have other shapes than the one showed in FIG. 1, and the heating system 1 according to the invention may be provided with a number of other tanks for heating of fluids or other materials. It would be beneficial to provide such other tanks with internal or external thread 7 in their open extremity 6, so that they may be screwed together with the adapter 8 for heating of the material therein. In connection to heating of fluid or another material in the tank 3, it is up to the user to take into account any pressure rise in the closed tank that could occur during the heating. In order to prevent damage to the material and/or the personnel in case of over-pressure in the tank due to the heating, the heating system 1 according to the invention may advantageously be provided with a safety valve connected to the interior of the tank 3, in order to provide a passage for equalization of pressure relative to the atmosphere in case of over-pressure in the tank 3. Accordingly, it is not necessary that a fluid-filled tank is screwed together with the adapter 8 during the heating process. The heating system 1 may, near the handle 4, furthermore be provided with a pivotal bow 9 for suspension of the system 1, by way of example suspension in a belt on a uniform.

The heating pipe 5 is closed in the lower extremity in order to prevent fluid from surging up in the pipe. Accordingly, there is no entry of fluid from the tank 3 into the handle 4 or into the pipe 5. The safety valve, which must carry out the equalization of pressure, may also be located in the adapter 8.

In the pipe 5 there is installed a catalytic burner that is supplied with gas to the process from a gas tank/energy cell in the handle 4. Between the gas tank and the catalytic burner in the pipe 5 there is provided a valve, which can be controlled by use of a regulator via a button 11. In order to make the catalytic process start, it is necessary to heat the catalyst. This can be done by pushing a push button 10 as shown in FIG. 1*b*. The push button 10 both ignites and opens for the gas so that the heating unit 2 may be operated with one hand. Air suction and exhaust of gas is provided via openings in the upper part of the handle, in which there in FIGS. 1*a* and 1*b* is shown the air suction opening 12, while the exhaust opening on the opposite side of the handle is not show in this figure. Such suction openings 12 and exhaust openings may be provided with a regulation valve 13 for regulation of the volume of intake air and exhaust gas, respectively, through the openings.

Figure 2:
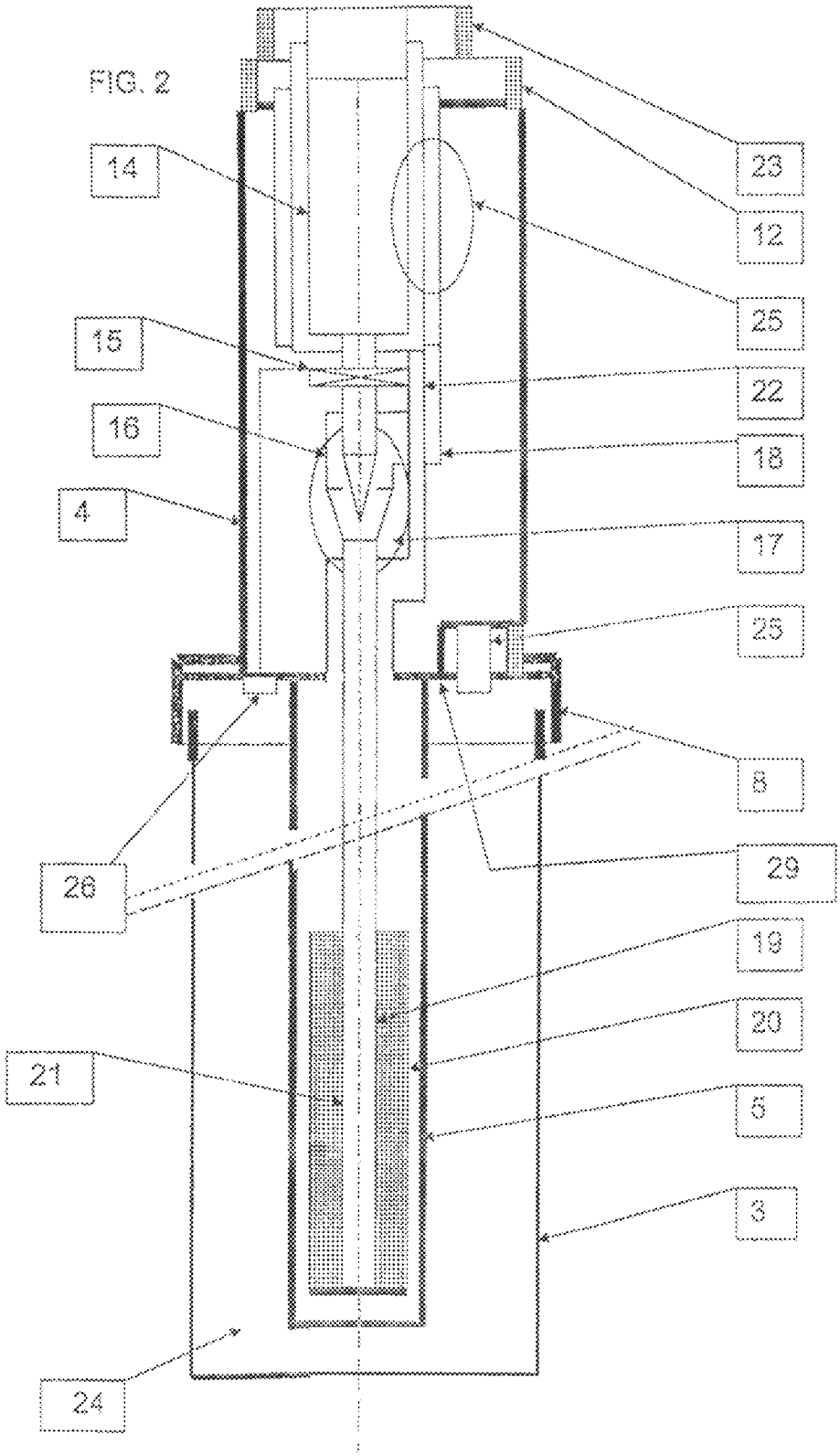
FIG. 2 is a detailed sketch of the heating system.

In FIG. 2 is shown a specific embodiment of the more general heating system 1 shown in FIG. 1. The sketch in FIG. 2 shows the handle 4 with the heating pipe 5 inserted into the built-on tank 3. The handle 4 comprises a gas tank 14, from which gas is released via a regulator 15, for example by operating a button 11 as shown in FIG. 1*a*, and fed into a nozzle 16. Such nozzle 16 is preferably part of a venturi system 17, so that the gas carries air and hence oxygen along with it, when the gas is fed out of the tank 14. This air is provided via the pipeline 18 that is connected to the inlet port 12. The gas and air mixture is fed through a transport pipe 19 between the venture system 17 and a catalytic element 20. The transport pipe 19 is on the same level as the catalytic burner 20, which may be provided with apertures or an adjusted length in interaction with a special shaped bottom that forms the closing section of the catalytic element 21 in order to ensure a smooth flow and gas-air distribution in the catalytic burner 20. After the catalytic process, in which the fuel gas is converted to carbon monoxide and water vapour, these exhaust gases are fed through another pipe system 22 to an exhaust opening 23 in the opposite section of the handle 4.

The catalytic burner 20 can have different geometrical shapes depending on the intended application and efficiency. As an example it may comprise or be comprised of two plane units or of one or more curved units, for instance cylindrical units. By way of example the burner may be comprised of more plates with gas supply in the periphery of the burner in order to ensure a lower temperature of the gas and a larger heating surface per unit area of the catalytic burner, which all things being equal should ensure an even higher efficiency than with the cylindrical heating surface.

The catalytic process produces a great amount of infra-red radiation, which is being transmitted through the material of the heating pipe 5 and into the tank 3, which is closed upwardly with a partition wall 29. The medium in the tank 3 is being exposed to the infra-red radiation that especially heats the water in the tank 3. In order to ensure an effective utilization of the infra-red radiation, the tank 3 may be provided with a reflective coating on the inside, in order to reduce the emission of heat through the wall of the tank 3. It is furthermore possible to construct the tank 3 with a general heat insulating wall, optionally with a multi-layered structuring as known from thermos bottles.

With a heat insulating tank 3 and a handle that is not heated, it is difficult to trace the use of such heating system 1 according to the invention in relation to military actions, because the emission of heat, by this way, is minimised. A certain kind of emission of heat that imply a potential risk of tracing during application, is associated to the heated emissions (gas, water vapour) from the known catalytic process through the exhaust opening 23. To reduce the temperature of the exhaust gases there is provided a counter flow heat exchanger 25 that, at least in part, encloses the gas tank 14 in order to trans-form heat from the exhaust emissions to the gas in the gas tank. Moreover, the pipe-line 22 for the exhaust gas is, at least in part, surrounded by the pipeline 18 for the intake air through the inlet port 12. Accordingly, heat is transferred from the emission gases to the gas tank and to the intake air, which contributes towards an optimal combustion. In this connection it should be mentioned, that the gas from the gas tank 14 during expansion after the nozzle 15 in the venturi system 17 entails a cooling of the gas so that absorption of substantial amounts of heat from the exhaust is possible.

Emission of heat from the exhaust gas to the intake gas and the gas tank 14 contributes towards to ensure an expedient function of the heating system 1 according to the invention also in very cool surrounding. Therefore, the heating system 1 according to the invention is well suited for use both in hot and cool areas and due to its robust nature it is well suited for use in the military sector.

In the case of heating of fluids or another medium 24 in the tank 3, when it is mounted on the adapter 8, a possibly generated over-pressure in the tank 3 due to the heating induces a risk for the heating system 1 and for the user of it. In order to reduce the risk for damage of the apparatus and the personnel, the heating unit 1 is provided with a safety valve 25 between to the interior of the tank 3 and the atmosphere outside the tank. The safety valve opens a passage between the interior of the tank 3 and the surrounding atmosphere for equalization of pressure. The over-pressure valve is in the figure located in the adapter 8, but it is possible to provide a over-pressure valve in other appropriate places in the apparatus.

To be even easier to operate, the heating unit 2 may furthermore be provided with a heat sensor 26, which, by use of the infra-red radiation emitted by the medium 24, can measure the temperature of the medium 24.

Alternatively, such heat sensor 26 may comprise a thermometer that measures the temperature of the medium while being submerged into the medium. However, this embodiment is not shown in FIG. 2.

Thus, the heat sensor may be connected to a temperature indicator on the handle (not shown) or to an acoustic device that indicates when the medium 24 has reached a certain preset temperature. It may, as an example, be possible to set this temperature on a unit on the handle or the temperature may be preset, so that it is indicated when a certain temperature is reached, for instance by a sound or light indication on the handle. Hence, it may also be considered to use installed light indicators in different colours or a number of light indicators that is turned on depending on the temperature reached in order to indicate to the user the temperature reached or exceeded.

As a further alternative a thermo valve that regulates the gas flow directly to the catalytic burner may be inserted. If the temperature in the catalytic burner exceeds a preset temperature, this thermo valve will regulate the gas flow downwards until the temperature come down below the level that is permitted in the catalytic burner.

Figure 6:
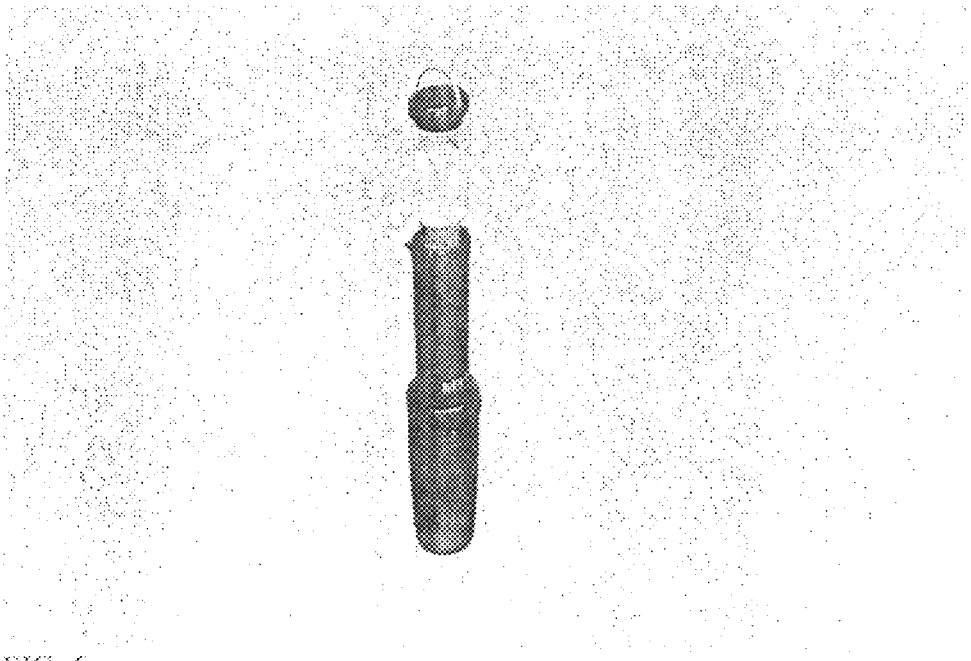
FIG. 6 shows an illustration in connection to the replacement of the gas tank/energy cell.

The gas tank/energy cell 14 is arranged in the upper part of the handle 4 to facilitate the replacement of it, which also is illustrated in FIG. 6, or to facilitate refuelling of gas to the gas tank 14.

Figure 3:
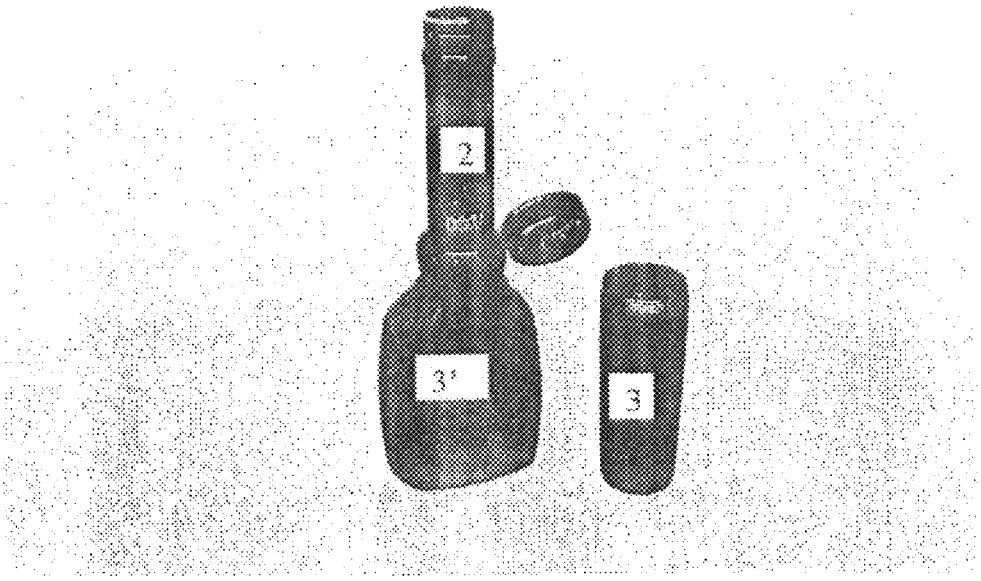
FIG. 3 shows an embodiment, in which the heating unit is fitted directly to the threaded bottleneck of a canteen.

In FIG. 3 is shown an embodiment, in which the heating unit 2 is fitted directly to the threaded neck of the canteen 3', which may have other shapes and sizes than the one showed. The canteen 3' may, depending on the selected degree of insulation, be applied directly for heating of water, moist masses or beverages or as a hot-water bottle or hand heater. It is possible to mount the heating unit directly on other kinds of canteens, water tanks, drinking bottles, thermos bottles and the like by adjusting the adapter 8. Likewise, the adapter 8 may be manufactured with both internal thread and external thread for adjustment to specially developed fluid tanks.

Figure 4:
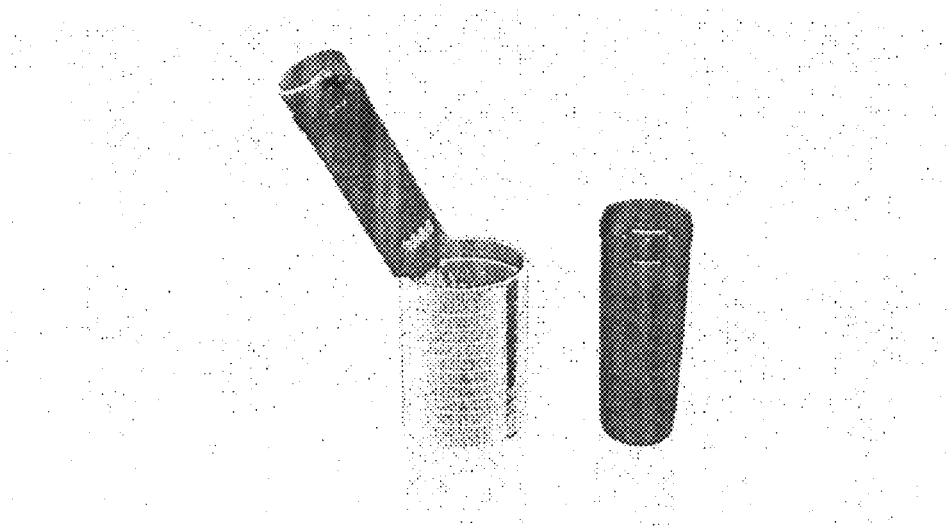
FIG. 4 illustrates the application in connection with heating of a medium in a tin.

In FIG. 4 is shown an application in connection to heating of a medium in a tin. The heating pipe may, at the same time, function as a spoon and a high-efficient heating element.

Figure 5:
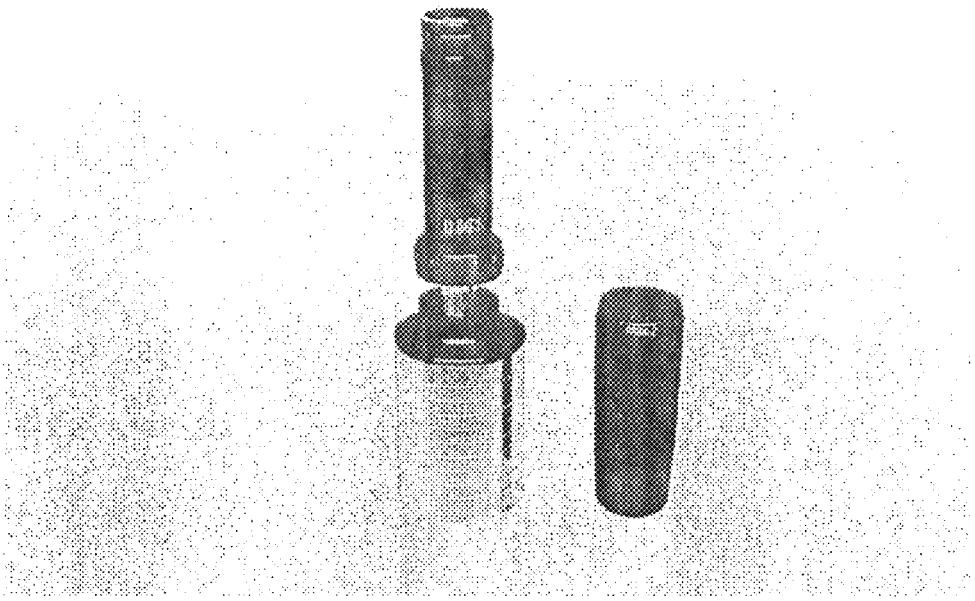
FIG. 5 shows the heating unit submerged in a tin that is provided with a corresponding adapter.

In FIG. 5 the heating unit is emerged into a tin that is provided with a thread corresponding to the adapter so that the heating unit may be screwed together with the adapter, which fits tightly to the upper edge of the packing. The adapter may be provided with a skirt made in soft rubber, for instance approved by the American FDA, so that it covers the entire casing of the packing. Hereby the adapter will also be insulating and contribute to a fast heating, because the heat loss to the surroundings, all things being equal, will be reduced.

In FIG. 6 is shown an illustration in connection to a replacement of the gas tank/energy cell.

Figure 7A:
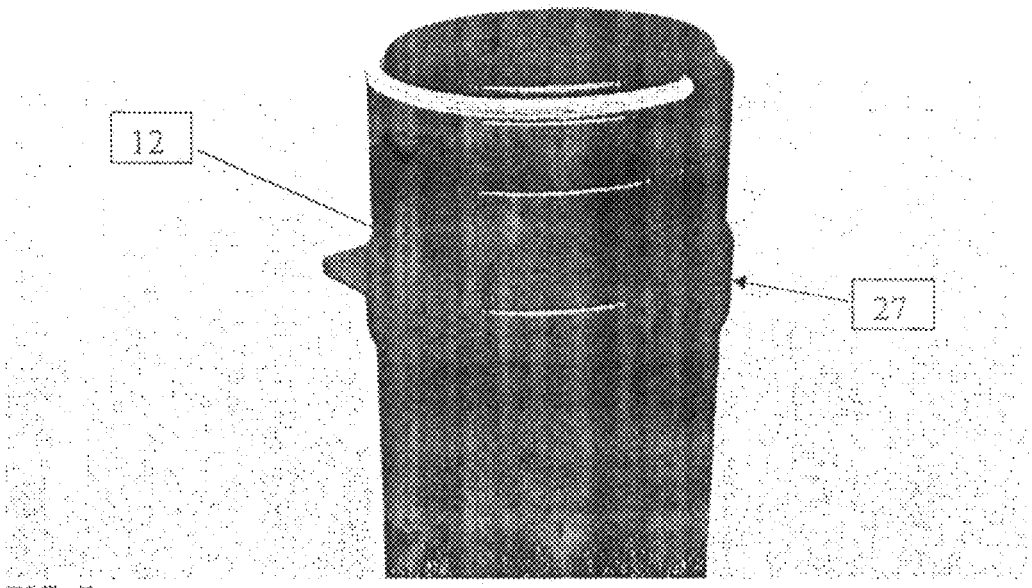
FIG. 7 shows a hand-operated valve, which a) can open and b) close the air intake and the exhaust of the heating unit respectively.
Figure 7B:
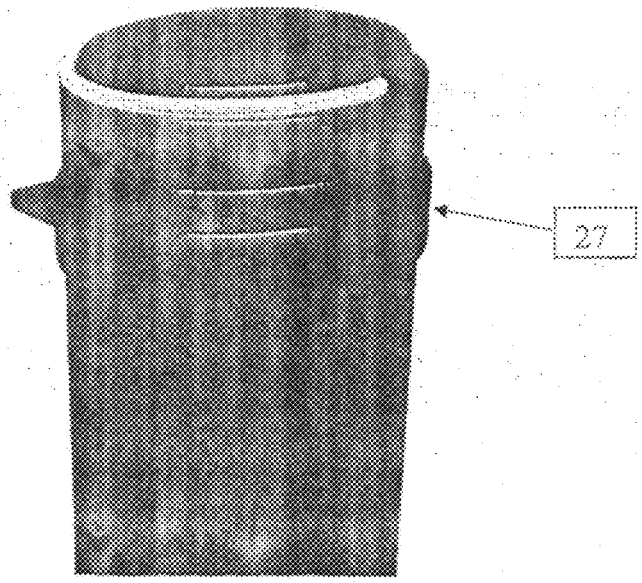

In FIG. 7 is shown a hand operated valve 27 that can open and close for the air intake 12 and exhaustion of the heating unit, respectively. The valve 27 is shown in open position in FIG. 7*a* and in closes position in FIG. 7*b*.

Figure 8A:
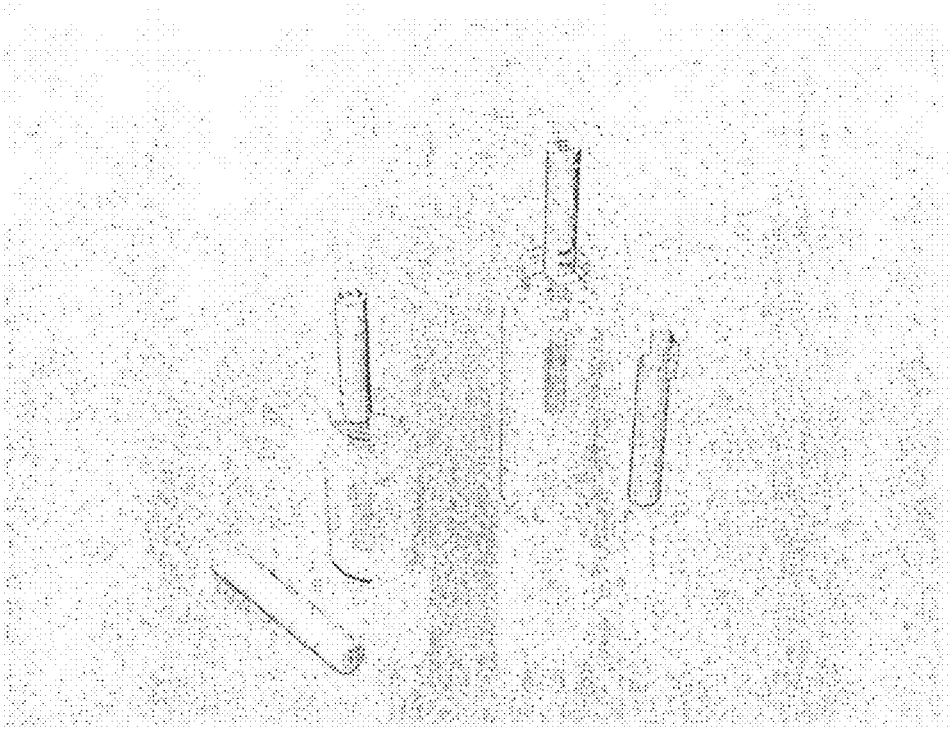
FIGS. 8*a* and 8*b* show alternative embodiments designed especially for use in connection to bottles, feeding bottles and glass for infants.
Figure 8B:
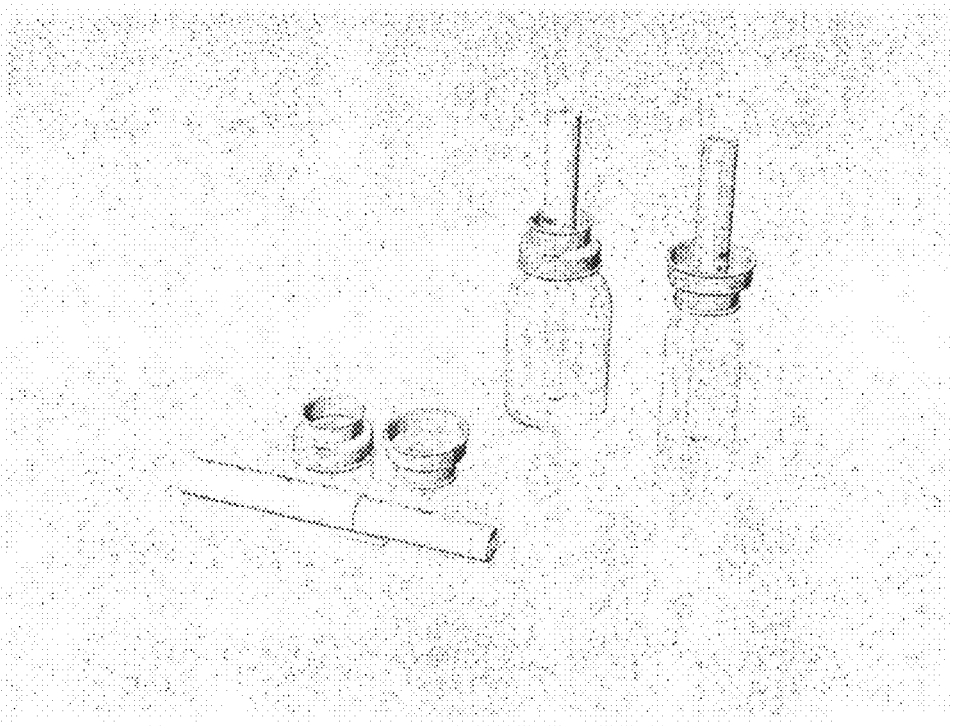

FIG. 8*a* shows an alternative embodiment special designed for use for parents that have young children and wishes to be able to heat milk and baby food directly in the packing. FIG. 8*b* shows the same heating system, however, with a replaceable adapter intended for attachment to e.g. a standard feeding bottle or a standard baby food packing. Hereby it is possible for the minder of children to put the feeding bottle/baby food in the pocket while the person for instance consoles the hungry child in the middle of the nature.

Figure 9:
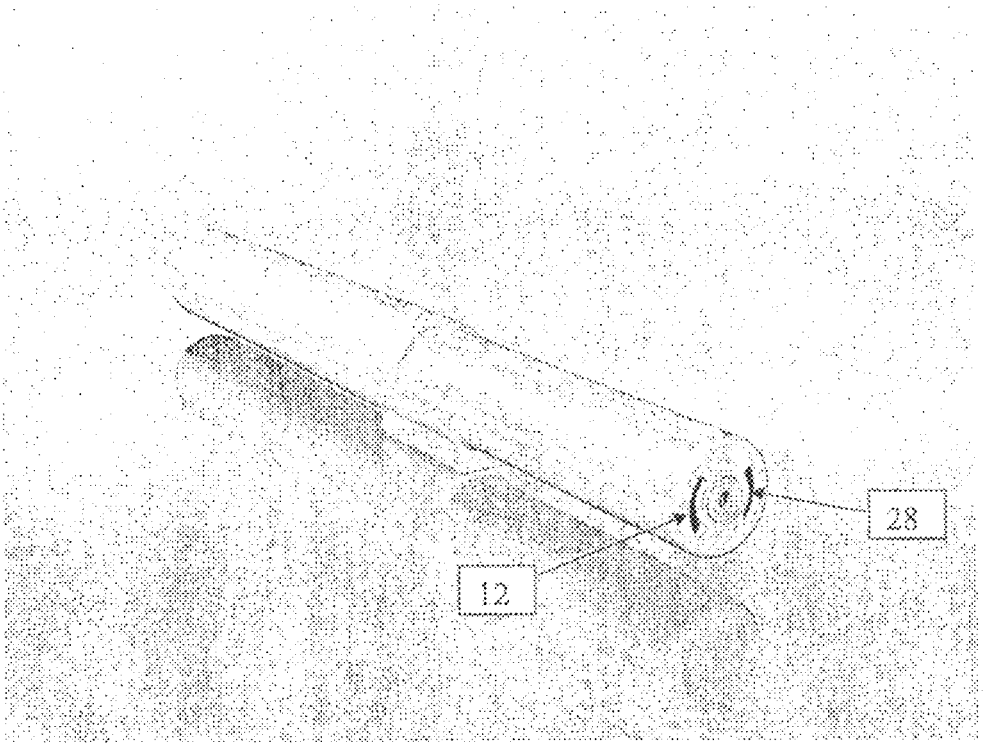
FIG. 9 shows the alternative heating unit packed together for storing and transport.

FIG. 9 shows the alternative heating unit packed together for storing and transport. Air intake 12 and exhaustion of gas 28 is provided on the end face and may have a colour indication that depends on whether they are open or closed. A red marking communicates as an example to the user that the air intake 12 and exhaustion 28 of the heating unit are closed and accordingly protects against ingress of unwanted foreign objects.

The invention claimed is:

1. A portable catalytic heating system in which the heating system comprises a heating unit with a handle (4) and, in extension thereof arranged a heating pipe (5) containing a catalytic burner (20) for catalytic combustion of gases for providing infra-red radiation, wherein the heating pipe (5) is fluid-proof for immersion in liquids, wherein a counter-flow heat exchanger is provided between a pipeline or pipe system (18) for air supply and a pipeline (22) for vent gases for heat exchange between vent gas and supplied air and wherein there is provided a heat exchanger between a gas tank (14) in the heating system and a pipeline or pipe system (22) for vent gases for heat exchange between vent gas and gas in the gas tank (14).

2. A portable catalytic heating system according to claim 1, in which the catalytic burner (20) is configured to provide infra-red radiation with wavelengths between 3 and 7 μm.

3. A portable catalytic heating system according to claim 1, wherein a venturi system (17) for mix of fuel gas and air is provided between a gas tank (14) and the catalytic burner (20).

4. A portable catalytic heating system according to claim 1, wherein the heating system comprises a replaceable gas tank (14).

5. A portable catalytic heating system according to claim 4, wherein the gas tank (14) is arranged in the handle (4).

6. A portable catalytic heating system according to claim 1, wherein the heating unit comprises a heating sensor for measurement of the temperature of a medium heated by the heating unit.

7. A portable catalytic heating system according to claim 1, comprising a tank (3) dimensioned to receive the heating pipe (5), wherein the handle (4) and the tank (3) have corresponding adapters for mutual fluid-proof connection.

8. A portable catalytic heating system according to claim 7, wherein the tank (3) has a wall and bottom comprising a heat insulating layer to prevent heat loss.

9. A portable catalytic heating system according to claim 1, wherein the efficiency of the apparatus is over seventy percent.

10. The portable catalytic heating system according to claim 1, wherein the heating pipe (5) is produced in a material comprising aluminium, copper, or quartz glass or a combination of these.

11. The portable catalytic heating system according to claim 1, wherein the heating pipe (5) is produced in a material that is transparent for infra-red radiation.

12. A portable catalytic heating system for off grid application, in which the heating system comprises a heating unit with a handle (4) and in extension hereof arranged a heating pipe (5) containing a catalytic burner (20) for catalytic combustion of gases for providing infra-red radiation, wherein the heating pipe (5) is fluid-proof for immersion in liquids, wherein a gas supply for the catalytic burner (20) in the heating pipe (5) is provided between the catalytic burner and the inner wall of the heating pipe (5), wherein the handle (4) is provided with an adapter for fluid-proof attachment of the heating unit to a tank (3) with a corresponding adapter and wherein the heating system comprises a safety valve for opening of a passage between the interior of the tank (3) and the surrounding atmosphere for equalization of pressure in case of pressure above a predetermined level.

13. The portable catalytic heating system according to claim 12, wherein the heating pipe (5) is produced in a material comprising aluminium, copper, or quartz glass or a combination of these.

14. The portable catalytic heating system according to claim 12, wherein the heating pipe (5) is produced in a material that is transparent for infra-red radiation.

* * * * *